United States Patent [19]

Tatum

[11] 4,170,532

[45] Oct. 9, 1979

[54] DEEP WELL PLATINIZED ANODE CARRIER FOR CATHODIC PROTECTION SYSTEM

[75] Inventor: Joe F. Tatum, Hattiesburg, Miss.

[73] Assignee: C. E. Equipment, Inc., Hattiesburg, Miss.

[21] Appl. No.: 895,402

[22] Filed: Apr. 11, 1978

[51] Int. Cl.[2] ..... C23F 13/00

[52] U.S. Cl. ..... 204/196; 204/147; 204/286; 204/290 F; 204/284

[58] Field of Search ..... 204/196, 147, 290 F

[56] References Cited

U.S. PATENT DOCUMENTS

| | | | |
|---|---|---|---|
| 3,081,252 | 3/1963 | Preiser et al. | 204/196 |
| 3,458,643 | 7/1969 | Dorr | 204/196 |
| 3,647,672 | 3/1972 | Mehandjieu | 204/284 |
| 3,725,669 | 4/1973 | Tatum | 307/95 |
| 3,769,521 | 10/1973 | Caldwell et al. | 307/95 |

OTHER PUBLICATIONS

"The Use of Platinum Anodes on Land Based Installations".

"Texas Instruments Clad Metal Anode Products", Texas Instruments.

*Primary Examiner*—T. Tung

*Attorney, Agent, or Firm*—Dowell & Dowell

[57] ABSTRACT

An anode carrier for a deep well having a carbonaceous backfill which is used for the cathodic protection of underground metallic structures. The carrier includes an elongated electrically non-conducting tubular member having one or more apertures or windows and each of such windows is adapted to receive a platinized anode to which an impressed DC current is applied.

3 Claims, 3 Drawing Figures

DEEP WELL PLATINIZED ANODE CARRIER FOR CATHODIC PROTECTION SYSTEM

BACKGROUND OF THE INVENTION

1. 1 Field of the Invention

This invention relates generally to the cathodic protection of underground metallic structures and relates particularly to an apparatus for supporting one or more platinized anodes within a bore hole having a carbonaceous backfill which acts as a very low resistance to ground and thereby carries an impressed current from the anode into the surrounding soil.

2. Description of the Prior Art

Heretofore, it has been known that underground metallic structures, particularly structures made of ferrous metals, have corroded because such structures normally included both cathodic and anodic areas in which electric currents flowed to the metallic structure in the cathodic areas and flowed away from the structure in the anodic areas. It has been known that by providing a deep anode bed in the area of the metallic structure and causing an electric current to flow from the anode to the metallic structure, either from an impressed DC current applied to the anode, or by galvanic action, would cause the underground metallic structure to become substantially entirely cathodic and thereby reduce or prevent corrosion of such structure. Most of the anodes used in this type of protection system in the past have been sacrificial anodes in which the anodes deteriorated and after a few years it was necessary to replace the anodes. In my prior U.S. Pat. No. 3,725,669 a cathodic protection system was provided which substantially extended the life of the anode; however, the anodes still had to be changed periodically.

Some efforts have been made to provide substantially inert anodes which will not deteriorate by providing a substrate of titanium, tantalum or niobium (columbium) on which a relatively thin film or coating of a noble metal such as platinum or the like has been applied either by electrodeposition or by a cladding process. These inert anodes function for extended periods of time in the presence of a carbonaceous backfill or other electrolyte in a bore hole if the impressed current is maintained at a current discharge from the anode of approximately 20 amperes per square foot (2.15 amperes per square decimeter) or less so that the discharge remains as an electronic discharge instead of an electrolytic discharge. Ordinarily, the impressed current being discharged from the anode into the carbonaceous backfill is an electronic discharge and, therefore, little or no gas is generated. However, what little gas is generated normally is oxygen and perhaps some hydrogen and, when a chlorine ion is present, a small amount of chlorine gas likewise may be generated. Such gases normally occur at the periphery of the carbonaceous backfill and migrate to the area of the anodes where they tend to act as insulators and raise the resistivity to the passage of current. Therefore, it is important that means be provided for exhausting the gases from the area of the anodes. In offshore installations in which the electrolyte is sea water, the gases are free to pass through the water or be absorbed thereby. However, in deep well land installations, such gases may be trapped exteriorly of the anode carrier within the carbonaceous backfill material.

Some other examples of prior art structures are the U.S. Pat. Nos. to Dorr 3,458,643; Mehandjiev 3,647,672; Caldwell et al 3,769,521; as well as "Texas Instruments Clad Metal Anode Products", Texas Instruments Inc., Clad Metal Anode Products, Attleboro, Mass. 02703, Publication No. 186; and by an article entitled "The Use of Platinum Anodes on Land-Based Installations" published 1975 at a Symposium by Marston Excelsior Ltd., Wolverhampton, England.

SUMMARY OF THE INVENTION

The present invention is embodied in a deep well anode carrier for cathodic protection systems in which the carrier is placed within a deep bore hole and surrounded by a carbonaceous backfill which extends upwardly substantially to the surface of the earth. The carrier includes an electrically non-conducting tubular member having one or more apertures along its length as well as at least one aperture adjacent to the lower end and each of such apertures is provided with mounting means for receiving an inert perforate platinized anode in such a manner that the anodes are held in fixed position relative to each other and are located at desired positions along the length of the bore hole. Additionally the perforated anodes and the carrier provide vents for any gases which are generated, provide protection for the anode lead wire, and provide fluidizing means for removing the carrier as well as the anodes carried thereby so that such anodes may be checked periodically.

It is an object of the invention to provide a deep well anode carrier having one or more apertures which receive and support one or more platinized anodes in intimate engagement with a carbonaceous backfill and to connect such anodes to a surface rectifier which supplies the anodes with an impressed DC current that is used for protecting underground metallic structures.

DESCRIPTION OF THE PREFERRED EMBODIMENT

Figure 1:
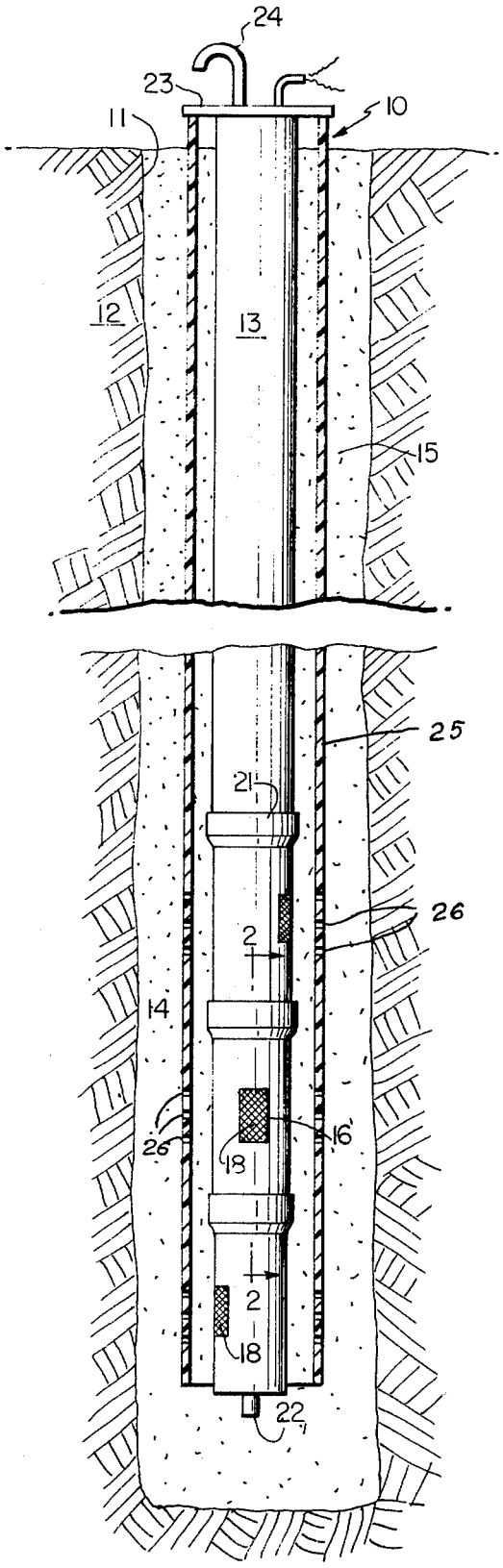
FIG. 1 is a side elevation illustrating one application of the invention in use.

With continued reference to the drawing, an elongated tubular carrier 10 of indeterminate length is provided which can be placed within a bore hole 11 extending a substantial distance into the ground 12. Preferably the carrier 10 includes an elongated hollow imperforate tubular member 13 having one or more relatively short tubular members or pipe sections 14 located at the lower end. Since different layers or strata of earth have varying resistivity to the passage of electrical current, one or more additional short tubular members or pipe sections may be located intermediate the ends of the carrier 10 in the areas of least resistance. The tubular member 13 and each of the pipe sections 14 are constructed of electrically non-conductive material such as ABS, epoxy and other thermoplastic materials which normally are not subject to attack by chemical elements in the soil. After the carrier 10 is in position within the bore hole 11, the space between the carrier and the walls of the bore hole is filled with a carbonaceous backfill 15 such as fluid calcined petroleum coke, coke breeze, or other material which acts as a very low resistance to ground.

Figure 3:
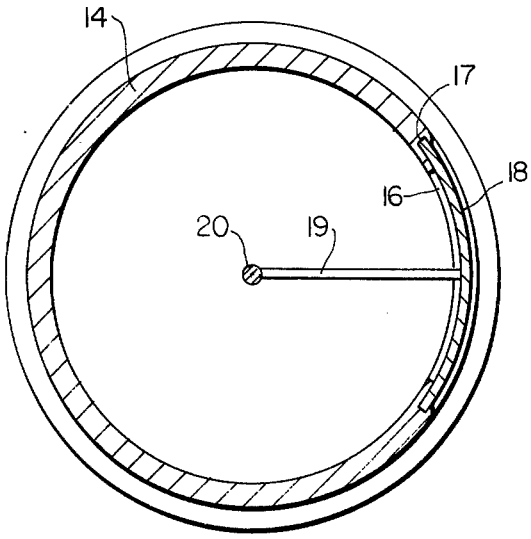
FIG. 3 is an enlarged section taken on the line 3—3 of FIG. 2.

Each of the pipe sections 14 is provided with one or more windows or apertures 16 having a groove or recess 17 around its periphery which is adapted to receive a relatively thin anode 18. Such anode may be of any desired configuration, such as wire mesh material, perforated sheet material, or expanded metal material. As illustrated best in FIG. 3, one side of the groove 17 is shorter than the other side so that the anode 18 may be snapped into the groove with the lead wire 19 of the anode extending into the pipe section. However, it is noted that the window 16 could be of stepped construction with the anode resting on the step and being held in place by a separate frame overlying the borders of the anode and attached to the pipe section in any conventional manner, such as by screws, adhesives and the like.

Figure 2:
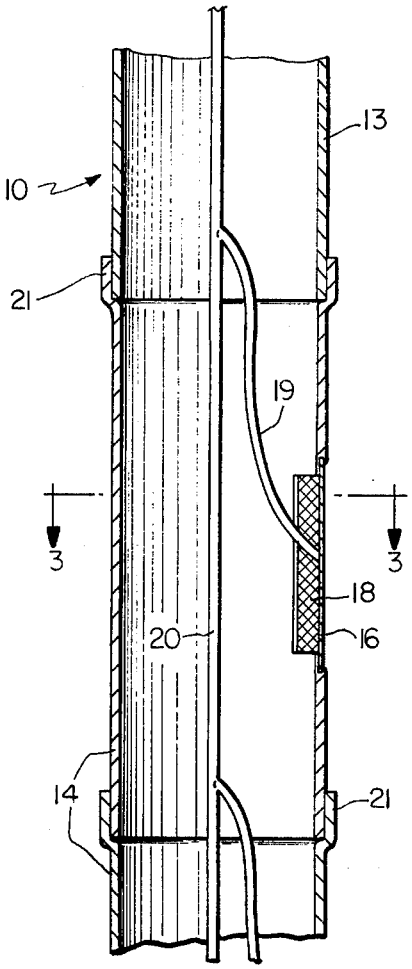
FIG. 2 is an enlarged fragmentary section taken on the line 2—2 of FIG. 1.

Each anode preferably includes an electrically stable substrate such as titanium, niobium (columbium), tantalum or the like which has been plated or coated with a noble metal such as platinum. The platinum is plated or coated on the substrate material in any conventional manner, as by electrodeposition, cladding or the like. Within the tubular carrier 10, the anode lead wire 19 is connected to an insulated electric line 20 which extends through the carrier to a position adjacent to the bottom thereof. In order to connect the lead wire 19 to the electric line or conduit 20, such lead wire extends outwardly of the short tubular member or pipe section 14 so that the end of the lead wire may be connected to the conduit 20 by welding, soldering or the like. Thereafter the pipe section 14 is connected to the tubular member 13 or to the next adjacent pipe section 14 in any conventional manner. If desired, the pipe sections 14 may have a bell 21 at one end to facilitate such connection as shown in FIG. 2. It is apparent that when the tubular member 13 and the pipe sections 14 are in assembled relationship, such structure protects the conduit 20 and the lead wire 19 from damage.

The upper end of the electric line 20 is connected to a rectifier (not shown) which supplies a DC impressed voltage of sufficient density to provide a current flow or discharge from the surface of the anode 18 of approximately 20 amperes per square foot to the carbonaceous backfill 15. The backfill carries the current from the anode 18 into the soil through a substantially larger mass than is provided by the anode itself. By limiting the flow of current to the anode, the discharge from the anode to the carbonaceous backfill 15 remains as an electronic discharge or current transfer and does not rise above the threshhold for electrolytic discharge.

The inert anodes will remain functional for many years; however, it may be desirable to remove the carrier periodically during that time to inspect the condition of the anodes. In order to withdraw the carrier from the backfill, the lowermost pipe section 14 is provided with an imperforate bottom having a check valve 22 of conventional construction mounted thereon which permits liquid to flow out of the carrier but normally does not permit liquid to flow into the bottom thereof. When it is desired to remove the carrier, the interior of the carrier is filled with water from the surface, while simultaneously water may be introduced into the bore hole exteriorly of the carrier. Water from within the carrier passes through the windows 16 and through the valve 22 to cause the carbonaceous material 15 along the length of the carier to be fluidized so that the carrier may be removed. After the anodes have been checked, the carbonaceous material again is fluidized by introducing water into the bore hole to permit the carrier to be inserted into such backfill.

The rectifier at the surface is operated continuously year after year to discharge an impressed current from the anodes into the carbonaceous backfill and such discharge may cause the carbonaceous backfill material to deteriorate slowly and create gases which act as an insulator unless such gases are removed. Since the anodes are perforated, such gases pass through the anodes and the windows or apertures 16 into the interior of the carrier. Preferably the upper end of the carrier is closed by a cap 23 to prevent foreign materials from entering the carrier and such cap has a vent pipe 24 for discharging gases accumulated within the carrier.

In some instances, it may be desirable to protect the carrier and the relatively fragile anodes carried thereby from cave-ins of the walls of the bore hole and to permit the carrier to be removed for inspection even though a cave-in may occur. In order to do this, a casing 25 of dielectric thermoplastic material may be inserted into the bore hole prior to the introduction of the carbonaceous backfill material. Thereafter, the carrier 10 is placed within the casing and the carbonaceous backfill material is added between the casing and the wall of the bore hole as well as between the casing and the carrier 10. The casing normally has one or more windows or openings 26 adjacent to each anode so that the impressed current flows from the anodes through the inner backfill material, through the windows 26 to the outer backfill material and then into the earth. The casing 25 remains in position when the carrier is removed for inspection.

In the operation of the device, the bore hole 11 is drilled to a desired depth in the general vicinity of an underground metallic structure, after which the carrier 10 is lowered into the bore hole so that the short tubular members or pipe sections 14 and the anodes 18 carried thereby are located in desired positions. The carbonaceous backfill 15 is introduced into the space between the walls of the bore hole and the carrier preferably by adding the backfill material to a supply of water or other liquid which is then pumped into the bore hole. Since the carbonaceous backfill material has a specific weight of two, such carbonaceous backfill settles toward the bottom of the bore hole and is compacted into intimate engagement with the carrier 10 and the anodes 18 regardless of whether the bore hole is substantially dry or extends into the water table.

The protection system is placed in service by connecting the electric line 20 to a source of DC power, such as a rectifier or the like, and sufficient electrical energy is introduced through the electric line 20 so that each of the anodes discharges a flow of electrical energy of approximately 20 amperes per square foot into the carbonaceous backfill, and such current flows through the backfill and the earth to the underground metallic structure so that the entire surface of the underground metallic structure becomes cathodic and thereby prevents or substantially delays rust and other corrosion. Since the anodes are constructed of substantially inert materials and the current discharge from such anodes is maintained below the threashhold for electrolytic discharge, the system may operate for many years without failure. Any consumption of materials caused by the flow of electrical energy is restricted to the cabonaceous backfill which can be easily replaced by adding additional carbonaceous backfill material to the top of the bore hole, preferably in a fluidized state.

The carrier 10 supports the anodes 18 in a desired position and additionally provides protection for the electric line 20 and the anode lead wires 19, provides a vent for gases which may be generated, and provides a system by which the anodes may be easily removed for purposes of inspection.

I claim:

1. Apparatus for use in a deep well bore hole in a cathodic protection system for underground metallic structures comprising an elongated hollow carrier of electrically non-conductive material which is normally located within the bore hole, said carrier including an elongated imperforate first tubular member having at least one short second tubular member connected axially thereof, said second tubular member having wall structure defining an opening, said wall structure having a recessed groove extending entirely around said opening, an inert perforate anode mounted in said groove and extending entirely across said opening, said anode including an electrically stable structure which is coated with a noble metal, an electric wire extending through said first tubular member and having one end connected to a source of DC impressed current, an anode lead wire having one end connected to said anode and the other end connected to said electric wire, and a carbonaceous material filling the space between said carrier and the walls of the bore hole and being in intimate engagement with said anode to transfer electric current from said anode to the earth, whereby electric current flows through the earth to an underground metallic structure and causes the structure to be substantially entirely cathodic.

2. The structure of claim 1 in which said stable substrate is selected from titanium, niobium, or tantalum.

3. The structure of claim 1 in which said noble metal is platinum.

* * * * *